US011414246B2

(12) United States Patent
McCluskey

(10) Patent No.: US 11,414,246 B2
(45) Date of Patent: Aug. 16, 2022

(54) ALL-GLASS TRAVEL MUG

(71) Applicant: Patrick James McCluskey, Lee, NH (US)

(72) Inventor: Patrick James McCluskey, Lee, NH (US)

( * ) Notice: Subject to any disclaimer, the term of this patent is extended or adjusted under 35 U.S.C. 154(b) by 0 days.

(21) Appl. No.: 17/101,844

(22) Filed: Nov. 23, 2020

(65) Prior Publication Data

US 2021/0155384 A1 May 27, 2021

Related U.S. Application Data

(60) Provisional application No. 62/939,652, filed on Nov. 24, 2019.

(51) Int. Cl.
*B65D 43/02* (2006.01)
*B65D 39/00* (2006.01)
(Continued)

(52) U.S. Cl.
CPC ..... *B65D 43/0214* (2013.01); *B65D 39/0005* (2013.01); *B65D 55/165* (2013.01); *B65D 81/3869* (2013.01); *B65D 2543/00046* (2013.01); *B65D 2543/0049* (2013.01); *B65D 2543/00092* (2013.01);
(Continued)

(58) Field of Classification Search
CPC ..... B65D 43/0214; B65D 39/0005; B65D 55/165; B65D 81/3869; B65D 2543/00305; B65D 2543/00092; B65D 2543/0049; B65D 2543/00546; B65D 2543/0097;
(Continued)

(56) References Cited

U.S. PATENT DOCUMENTS 957,809 A 5/1910 Steel
1,327,519 A * 1/1920 Bitler ..... B65D 39/16 215/355
(Continued)

FOREIGN PATENT DOCUMENTS

CA 2419437 C 11/2006
CN 202665022 U * 1/2013
(Continued)

OTHER PUBLICATIONS

Screen captures from Google search of "Tupkee tumbler". [Retrieved on Apr. 27, 2022] Results show glass tumbler with glass lid available for purchase through Amazon by Jan. 29, 2019. (Year: 2019).*

*Primary Examiner* — John K Fristoe, Jr.
*Assistant Examiner* — Eric C Baldrighi
(74) *Attorney, Agent, or Firm* — Lorusso & Assocoates

(57) ABSTRACT

A beverage container for hot or cold beverages, where the lid and base are connected via a glass joint. The glass joint forms a seal between the lid and base and eliminates the need for a synthetic material to form such a seal. The base has a double wall construction forming a cavity between the two walls. One or more of the surfaces facing the cavity are coated with a thermally reflective coating, which along with the glass materials, reduces heat transfer to the external surroundings. The lid is formed by a glass shell with an internal cavity, where the internal surfaces defining the cavity are optionally coated with a thermally reflective coating to further insulate the beverage container.

28 Claims, 6 Drawing Sheets

(51) Int. Cl.
*B65D 55/16* (2006.01)
*B65D 81/38* (2006.01)

(52) U.S. Cl.
CPC ..... *B65D 2543/00305* (2013.01); *B65D 2543/00546* (2013.01); *B65D 2543/00972* (2013.01)

(58) Field of Classification Search
CPC ..... B65D 2543/00046; B65D 39/0047; A47G 19/2288; A47G 19/2272
USPC ..... 220/592.2
See application file for complete search history.

(56) References Cited

U.S. PATENT DOCUMENTS

| | | | | |
|---|---|---|---|---|
| 1,997,055 | A * | 4/1935 | Graefe | A47G 19/2288 215/12.1 |
| 2,154,574 | A | 5/1938 | Martin | |
| D124,649 | S | 2/1940 | Fish | |
| 2,498,216 | A | 3/1948 | Luertzing | |
| 2,574,612 | A | 11/1951 | Barnes | |
| 2,813,651 | A | 11/1957 | Schlumbohm | |
| 2,895,636 | A | 7/1959 | Martin | |
| 3,156,279 | A | 11/1964 | Grebowiec | |
| 3,679,237 | A | 7/1972 | De Angelis | |
| 4,427,123 | A | 1/1984 | Komeda | |
| 4,442,572 | A | 4/1984 | Keck | |
| 5,178,724 | A | 1/1993 | Padamsee | |
| 5,515,995 | A | 5/1996 | Allen | |
| 5,810,399 | A | 9/1998 | Platano | |
| 5,918,761 | A | 7/1999 | Wissinger | |
| 6,119,889 | A * | 9/2000 | Fujii | A47J 41/0077 220/592.27 |
| 6,405,892 | B1 | 6/2002 | Volan | |
| D563,172 | S | 3/2008 | Bodium | |
| D587,528 | S | 3/2009 | Trombly | |
| 8,393,487 | B1 * | 3/2013 | Pillers | B65D 47/265 220/253 |
| 9,555,948 | B2 | 1/2017 | Nemeth | |
| 9,750,360 | B2 | 9/2017 | Price | |
| 2005/0167390 | A1 * | 8/2005 | Dubs | B65D 39/025 215/274 |
| 2009/0199719 | A1 * | 8/2009 | Bodum | A47J 31/20 99/275 |
| 2011/0114655 | A1 | 5/2011 | Bailey | |
| 2015/0216343 | A1 * | 8/2015 | Price | A47G 19/2288 156/275.3 |
| 2016/0058226 | A1 | 3/2016 | Christopoulos et al. | |
| 2017/0127860 | A1 | 5/2017 | Khalaf | |
| 2018/0050845 | A1 | 2/2018 | Chin et al. | |
| 2018/0072460 | A1 * | 3/2018 | Wolfson | B65D 83/0481 |

FOREIGN PATENT DOCUMENTS

| | | | | |
|---|---|---|---|---|
| CN | 202820672 U | | 3/2013 | |
| CN | 203658139 U | * | 6/2014 | |
| GB | 147654 A | * | 4/1921 | B65D 39/0047 |
| JP | 02139389 A | * | 5/1990 | B65D 39/0047 |
| KR | 20080002343 U | * | 7/2008 | A47G 19/2288 |
| WO | 2006/126197 A1 | | 11/2006 | |

* cited by examiner

ALL-GLASS TRAVEL MUG

CROSS-REFERENCE TO RELATED APPLICATIONS

This Regular Utility Applications claims the benefit of U.S. Provisional Application Ser. No. 62/939,652, filed Nov. 24, 2019, the contents of which are incorporated in their entirety herein by reference.

BACKGROUND OF THE DISCLOSURE

A common form of travel mug has a metal body with a glued plastic connector and plastic cap. The plastic cap might form a water-tight seal, though many such travel mugs do not seal completely. Such a travel mug can be single walled or double walled and may or may not have a handle. Another type of common travel mug consists of a metal body with a plastic lid and a rubber or silicone O-ring seal.

Through relevant art and common knowledge, the so-called "travel mug" beverage container is known. It is a common item in everyday life; it is found in a commuter's car, on a worker's desk, and in one hand while the other is carrying groceries among many other scenarios. In contrast to standard mugs, i.e., mugs without covers, travel mugs permit freer movement since the addition of a lid allows considerably more sloshing of the liquid without any substantial spills. The lids themselves are of a simple design; such lids are engineered to have two holes, one larger than the other, that are functionally complimentary. The larger one is designed to emit fluid flow for drinking while the smaller allows air into the mug to prevent a vacuum from developing as liquid exits. The holes are generally small relative to the overall dimensions of the lid and substantially reduce spills by limiting the flow of liquid through the drinking-designated hole. The holes themselves may have retractable or pivotable covers to better secure the fluid during movement events.

One type of construction of a travel mug is a metal body glued to a plastic connector. The connector is formed with threading that mates with corresponding threading formed on a lid that also may be formed from plastics, polymers, etc. A seal between the lid and plastic connector is created with the use of a compliant O-ring made from rubber, silicone, or other synthetic deformable material that is compressed between the mating parts. Another common construction is a metal body and plastic lid that are mated by compressing an O-ring between the body and lid, where the O-ring is situated in an annular recess around the circumference of the lid. The seal in this type of travel mug is created by inserting the plastic cap into the metal base thereby forming a "press fit" between the metal body and plastic cap.

Unfortunately, these relevant-art, travel-mug constructions have some drawbacks that prevent the user from fully enjoying their beverage. Most notably, the materials used in a typical construction can impart unwanted taste to the beverage and can add other negative sensorial aspects to the drinking experience. Materials used in the typical construction may cause health issues particularly with hypersensitive individuals. Materials used in the manufacture of mugs, and travel mugs in particular, can have deleterious environmental impacts when disposed.

There are a plethora of problems associated with beverage containers and common travel mugs in particular. A common travel mug is exemplary of the problems associated with such liquid containers. A common construction of such a mug includes a plastic lid, a metal base, and a synthetic O-ring seal. The plastic lid, metal base, and synthetic O-ring can impart unwanted taste and odor to the user during beverage consumption from such a travel mug. Also, some of the synthetic materials used to construct travel mugs have been shown to contain chemicals harmful to human health. Furthermore, synthetic materials as well as metals have negative environmental impacts. The present-day consumer is concerned about the quality of experience, health, and the environment. This consumer will not find a travel mug in the current marketplace that meets all these sometimes conflicting needs.

Plastic and metal materials often create unwanted and undesirable taste characteristics in foods and beverages. Something known as plastic taste, derived either from direct flavor or flavor scalping, has been associated with polyethylene (PE), polyethylene terephthalate (PET), and polysilicone chemicals. These chemicals are present in materials commonly used in travel mugs. In contrast, glass, which is not made with the listed chemicals, is highly inert, and does not impart a taste like plastic. Stainless steel, a common travel mug material, is known for imparting a metallic taste to beverages. Glass has a very neutral flavor, unlike synthetic materials and metals.

Smell is an important part of taste. Some researchers argue that smell is equally important to the experience of taste as the sense of taste received by the tongue. Synthetic materials give off odors in the form of volatile organic compounds (VOCs). The smell of plastic will influence the taste of a beverage consumed from a travel mug containing synthetic materials. At elevated temperatures, the production of VOCs from plastics increases. This is a particular concern for travel mugs because they are often used to consume hot beverages.

Deterioration of synthetic materials due to factors of time, temperature, chemical exposure, or sunlight exposure can also accelerate the production of VOCs. The deterioration will exacerbate the undesirable plastic taste and smell. Taste and smell can be further degraded by flavors and odors that synthetic materials absorb throughout the lifespan of a product from food, dishwater, or anything else to which it is exposed. Comparatively, glass is very stable regarding temperature, chemical degradation, and sunlight. Glass does not absorb flavors or odors.

Besides taste and smell, other senses influence our experience of a beverage, including the visual presentation, texture, and weight of a vessel, as shown in a growing body of work known as multisensory experience of taste. Preeminent chefs are aware of these factors that influence the experience of consumption as are discerning consumers. An all-glass travel mug offers the consumer more choice in a market that relies on synthetic materials and metal.

Chemicals found in synthetic materials can be toxic to humans, for example bisphenols, phthalates, and perchlorates. Glass is not toxic to humans. Glass is inert, non-leaching, and humans have been using it for thousands of years without any deleterious effects.

Glass is a more sustainable material than synthetic materials or metals. Synthetic materials are made from petroleum, a non-renewable resource and a by-product of the oil and gas industry; petroleum is derived from fossil fuels responsible for global warming. The extraction process is dangerous and harms the environment. Metal fabrication also begins with an extractive process that requires moving vast amounts of earth, often destroying fragile habitats and polluting nearby waterways. Synthetic materials are persistent and toxic to humans and the natural environment. Metals are rare and energy intensive to process. Glass, on the other hand, is made primarily from silicates such as quartz common in sand. The process is safe and relatively low energy. At the end of life, products made from glass degrade back to sand or can be recycled into other glass products.

Synthetic materials are persistent and toxic to the environment. Synthetic materials can harm wildlife by clogging their digestive systems, which prevents food digestion and nutrient absorption. When wildlife consume synthetic materials, these materials enter the food chain and can impact human food supplies. Synthetic materials are a blight on coastal areas and the open ocean. While it is true that broken glass can also form hazardous litter, the long-term negative impacts are significantly less, and hazards can be minimized by appropriate behavior and control of glass waste.

The multisensory experience of taste is a burgeoning field. Most of the research to date has focused on food and little has been done around beverages. None of the research appears to look at travel mugs. Within the field of multisensory experience of taste, few people know that synthetic materials produce aromatics that can directly flavor a beverage or indirectly flavor through odor. It is unlikely, therefore, that an expert in the field of multisensory taste would realize there was a problem with existing travel mugs or that it could be solved with an all-glass travel mug.

Still, an expert in the field might predict that people would prefer an all-glass travel mug to a mug that contains synthetic materials, given the option. The question is, would an expert in the field of multisensory taste raise that option themselves and understand how to create the solution. The proposition and its understanding are not obvious for two reasons. First, the proposition is not obvious because little if any research exists in the multisensory experience of travel mugs. Second, the understanding is not obvious because glass seals for beverage containers with drinking and venting holes do not exist, thus requiring an inventive leap in thought.

Furthermore, execution of a functional all-glass travel mug requires understanding that glass joints do not seal hermetically without sealing materials such as a grease or PTFE (polytetrafluoroethylene) tape. These sealing materials would also impart degraded function or unwanted taste to a beverage. The proposed all-glass travel mug disclosed herein uses a break in the glass seal as the drinking hole, which eliminates the possibility of a leak because it creates a fast flow path through the seal, essentially producing a leak at a preferred location. The breathing hole through the lid, a second break in the seal, allows air to replace the liquid exiting the container.

On the other hand, travel mug designers appear to be generally unaware of the negative aspects of current travel mugs caused by the synthetic materials used to construct travel mugs that negatively impact the multisensory experience of taste and the benefits of glass seals made from ground glass used for liquids. The combination of the above rare knowledge supports this disclosure as being novel and unobvious.

Insulated thermoses have features that more greatly reduce heat transfer than travel mugs. Thermoses are generally defined by a lid that completely seals the interior of the vessel from the exterior which prevents spills and convective heat losses entirely. In such thermoses, glass and vacuum insulation are used to reduce conduction, and highly reflective surfaces are used to reduce heat transfer by radiation. Such thermal-radiation-preventing surfaces have not been considered for travel mugs. Furthermore, the thermal reflective coatings considered in this disclosure are distinct and improved compared to those described in the relevant art, as disclosed in greater detail below.

The lids of travel mugs have received less attention regarding heat transfer than the bases. For example, double-walled glass lids do not appear to be described in the relevant art. In consideration of the above discussion, the following examples of relevant art are provided:

U.S. Pat. No. 5,918,761 provides an example of a typical travel mug. The seal between the lid and base is formed with an elastomeric material. The travel mug is described as rugged, with a preferred construction of a plastic lid and metal base.

U.S. Pat. No. 5,515,995 provides an example of a travel mug with a polymeric plastic base having a conical shape to prevent tipping. The lid "snap fits" to the base.

U.S. Pat. No. 4,427,123 provides a stainless-steel vacuum-insulated thermos with a metal coating that surrounds the majority of the evacuated volume with an electroplated or electroless-plated, multi-layer metal coating consisting of a bright nickel layer, semi-bright nickel layer, and a layer of copper or silver. The nickel layers are preferably 10 to 20 microns thick and the silver or copper layers are 2 to 8 microns thick.

CA2419437 provides a double-wall, vacuum-insulated glass vessel with 70% to 95% of the inner wall or outer wall coated with a thermal radiation reflective coating. The purpose of the uncoated areas is to allow visibility into the vessel to determine the level of beverage contained therein. It should be noted this example is not suitable as a travel mug without modification, significantly and partially due to the presence of an evacuation tip provided to evacuate the space between the glass walls.

Further from the relevant art, double-wall glass beverage containers are known. These containers are typically hand blown and many commercial examples exist. Additional methods for making double-wall glass or ceramic containers have been created. The following are exemplary of this relevant art:

U.S. Pat. No. 9,750,360 provides a partial double-wall glass vessel where the inner vessel and outer vessel are connected with a light-cure adhesive.

US2009/0199719 A1 describes a double-wall glass vessel forming the base of a so called "French press".

U.S. D563172 provides the ornamental design of a double-wall glass mug.

Still further from relevant art, ground glass joints and methods for securing such joints are known. Glass joints are primarily used for scientific apparatus, and have some limited use in food-based applications, including vinegar cruets intended for pouring. The following are exemplary of this relevant art:

U.S. Pat. No. 124,649 provides the ornamental design of a glass joint.

U.S. Pat. No. 2,154,574 provides for a glass joint with at least one acid-etched surface. Also disclosed is a glass joint with a circumferential groove in the frustoconical surface of a ground glass stopper.

U.S. Pat. No. 2,498,216 provides for a glass joint useful for connecting glass tubes as part of a chemical apparatus.

Relevant art examples of ground glass joint retention clips are provided in U.S. Pat. Nos. 4,442,572 and 5,810,399.

What is needed is a travel mug that eliminates the use of synthetic materials and metals that can impart undesirable modifications for the sensorial experience of using a travel mug, have negative health impacts, and negative environmental impacts. What is further needed is a travel mug made from glass with a glass joint and ergonomic features incorporated with the glass joint design that make the travel mug suitable for beverage consumption. These and other objects of the disclosure will become apparent from a reading of the following summary and detailed description of the disclosure.

SUMMARY OF THE DISCLOSURE

In one aspect of the disclosure, an all-glass travel mug is formed with a glass body, a glass base and a glass lid. A ground-glass joint forms a connection and a seal between the base and lid. The base may have a double-wall construction where at least one of the inner wall or outer wall has a high reflectivity coating to reduce heat transfer by radiation. A cavity between the walls contains, air, vacuum, or low conductivity gas. The glass lid also may be double walled, forming a shell-type body with an interior cavity. The lid also may be coated and contain air, vacuum, or a low conductivity gas similar to the base of the travel mug.

In one embodiment, the lid has two breaks in the sealing surface, one forms the drinking hole for drinking and the other forms a vent hole to allow air to replace fluid flowing out of the travel mug. In a second embodiment, a modified lid has a plurality of holes on one half and at least one hole on a second half, where the multiple holes on the first half function as a strainer for loose leaf tea or similar beverages. The at least one hole on the second half forms a vent hole. These and other aspects of the disclosure will become apparent from a review of the appended drawings and a reading of the following detailed description of the disclosure.

BRIEF DESCRIPTION OF THE DRAWINGS

Various other objects, features and attendant advantages of the present disclosure will become fully appreciated as the same becomes better understood when considered in conjunction with the accompanying drawings, in which like reference characters designate the same or similar parts throughout the several views, and wherein.

DETAILED DESCRIPTION OF THE DISCLOSURE

Figure 1:
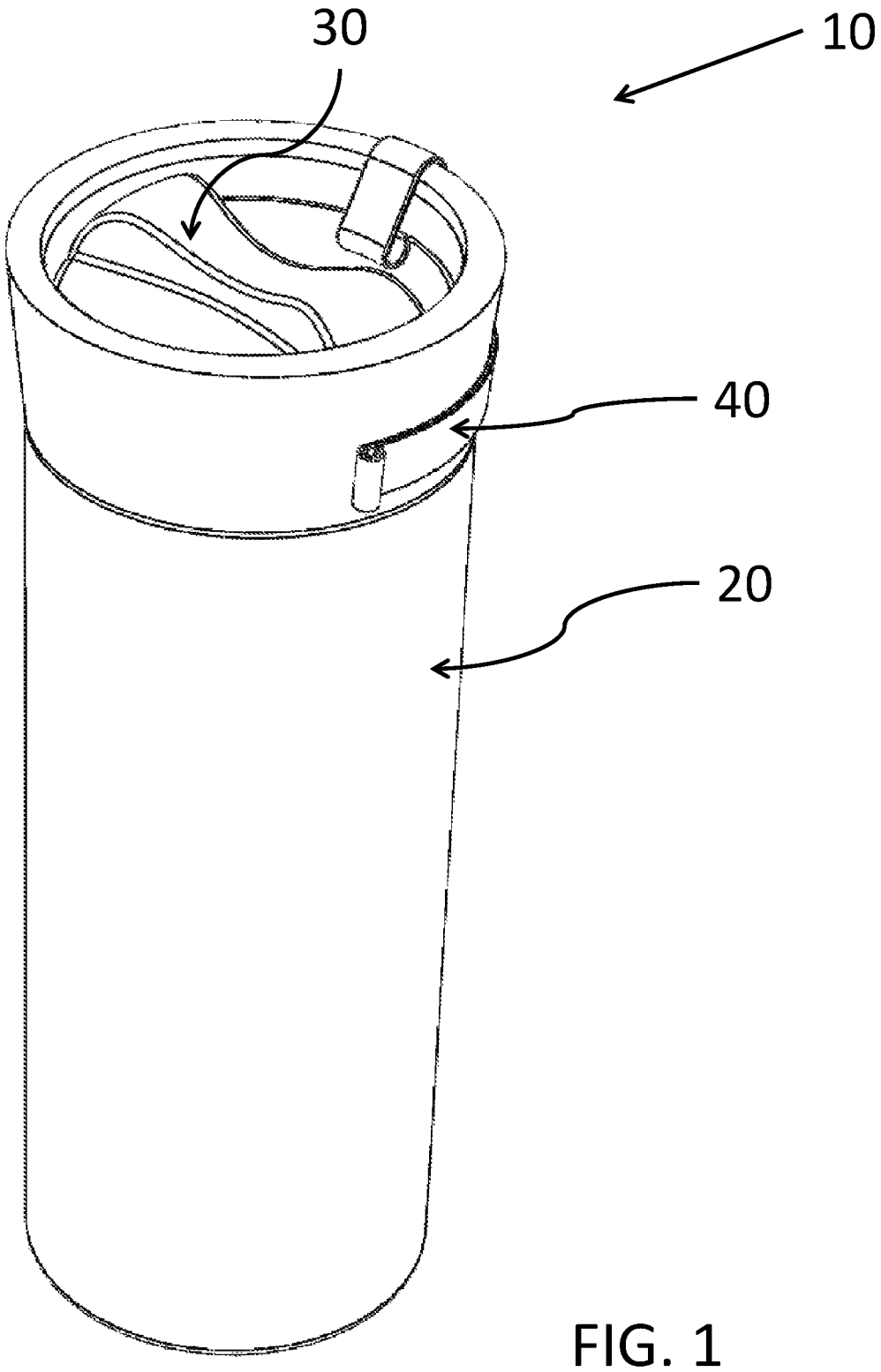
FIG. 1 is an upper-perspective view in elevation of a travel mug according to one embodiment of the disclosure.

Referring now to FIGS. 1-4, in one aspect of the disclosure, a beverage container designated generally as 10, includes a body 20 having an enclosed bottom end and an open upper end. Body 20 is constructed from glass that holds the beverage. A lid 30 is made of glass that prevents large-scale convective heat losses and spills. Lid 30 is secured to the open upper end of body 20. A clip 40 made of flexible material that prevents a jarring force from separating the body 20 from lid 30 is secured to, and registered against, body 20 and lid 30.

The lid 30 is sealed to body 20 at its upper end with a ground glass joint. The joint consists of a ground-glass outer face 31 on lid 30 and a ground-glass inner face 21 on body 20. The mating faces, 21 and 31, are frustoconical in shape with the surface angle the same on both faces to ensure substantially full registration between the surfaces, which maximizes the sealing function. The seal formed by the ground-glass joint is interrupted at two locations, a drinking port or drinking channel 32 and a venting port or vent channel 33. Drinking port 32 is configured to permit fluids to flow from beverage container 10 for drinking while venting port 33 relieves or neutralizes the vacuum created by the exiting fluid.

The thickness of lid 30 is set to significantly reduce heat loss by convection. In turn, both drinking port 32 and venting port 33 are long enough, the lengths of which are determined by the thickness of lid 30, to significantly reduce heat loss by convection. The length of the ports and thereto, the thickness of lid 30, by way of illustration and not limitation, may be greater than 4 mm and less than 40 mm. A range of from about 17 mm to about 23 mm may provide a good balance between lid thickness and heat retention in the beverage container. It is understood that a lid thickness at less than 4 mm and concomitant length of ports 32 and 33 will have little effect on reducing heat loss while a lid thickness above 40 mm will result in the travel mug 10 becoming too large, potentially unwieldy and uneconomical. A lid thickness and port lengths from about 17 mm to about 23 mm should provide an optimal balance between thermal insulation, scale, and cost. Drinking port 32 is positioned below the lip of body 23 to facilitate drinking from beverage container 10 with the lips pressed against body 20 so beverage fluid can be directed toward the mouth by face 21 and lip 23 while drinking.

Lid 30 has a raised grip 34, which is useful for installing and extracting lid 30 to and from body 20. Raised grip 34 is ergonomically shaped, with a depression 34*a* formed toward a central portion of raised grip 34, and with two raised areas 34*b* and 34*c* formed near outer portions of raised grip 34. The purpose of depression 34 is to create a void to accommodate the nose and philtrum while drinking. The purpose of the two raised areas, 34*b* and 34*c*, is to provide a larger portion to grasp raised grip 34.

The lid 30 is essentially a glass shell with from about a 1 mm to about a 3 mm wall thickness 35, and a cavity 36 defined by the walls of lid 35. Any portion of the walls of the lid may be coated with a thermally reflective coating. Lid 30 may also be left uncoated to maintain the materials natural transparency or translucency and enable viewing of the contents of the beverage container 10. The purpose of cavity 36 is to insulate an interior bottom surface 37 of lid 30 from an exterior surface 38 of the lid. Cavity 36 can contain air, vacuum, or a low conductivity gas, any of which provide an additional insulation factor.

Body 20 is a double-wall glass structure with an inner body wall 24 and an outer body wall 25, both with a thickness from about 1 mm to about 3 mm. A cylindrical body cavity 26 formed and defined by inner body wall 24 and outer body wall 25 insulates beverage fluids resident in body 20. Cavity 26 may be continuous with a bottom gap 26*a* formed between an inner of a base 27 and an outer base 28 that may be a continuous extension of an outer body wall 25 of body 20. The gap 26 breaks the conduction path for heat through inner and outer body walls, 24 and 25, of the beverage container by introducing a low-conductance barrier, such as air, vacuum, or other low conductivity gas. Optionally, a radially outer surface 24A of the inner body wall 24 and/or a radially inner surface 25A of outer body wall 25 is coated with a continuous and high-reflectivity coating 29. Coating 29 reflects heat back to an enclosed warm beverage and away from an enclosed cool beverage, thereby providing additional thermal insulation. Coating 29 may also be patterned with an artistic design.

Figure 2:
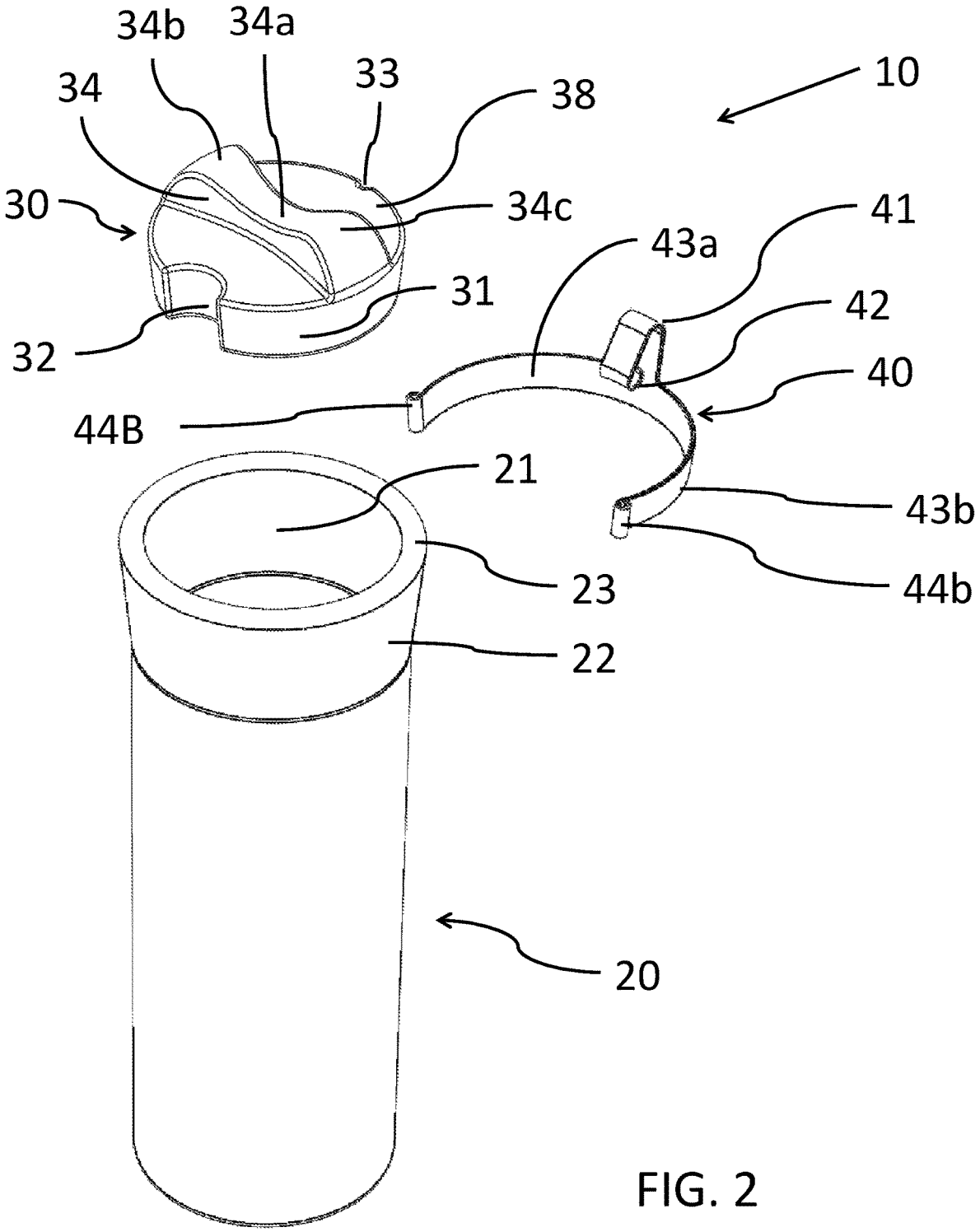
FIG. 2 is an upper-perspective, exploded view of the travel mug shown in FIG. 1.
Figure 3:
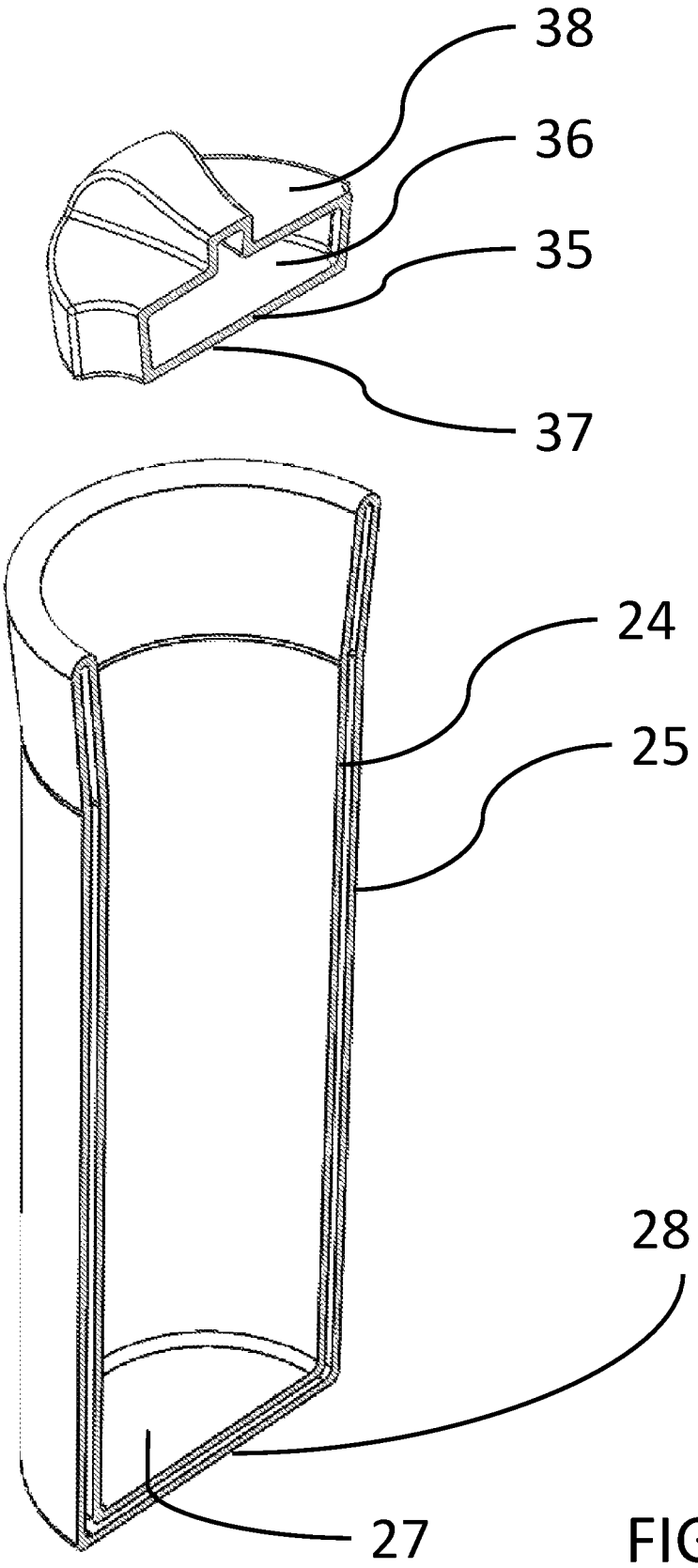
FIG. 3 is an upper-perspective, exploded, cross-section view of the lid and the body of the travel mug embodiment shown in FIG. 1.
Figure 4:
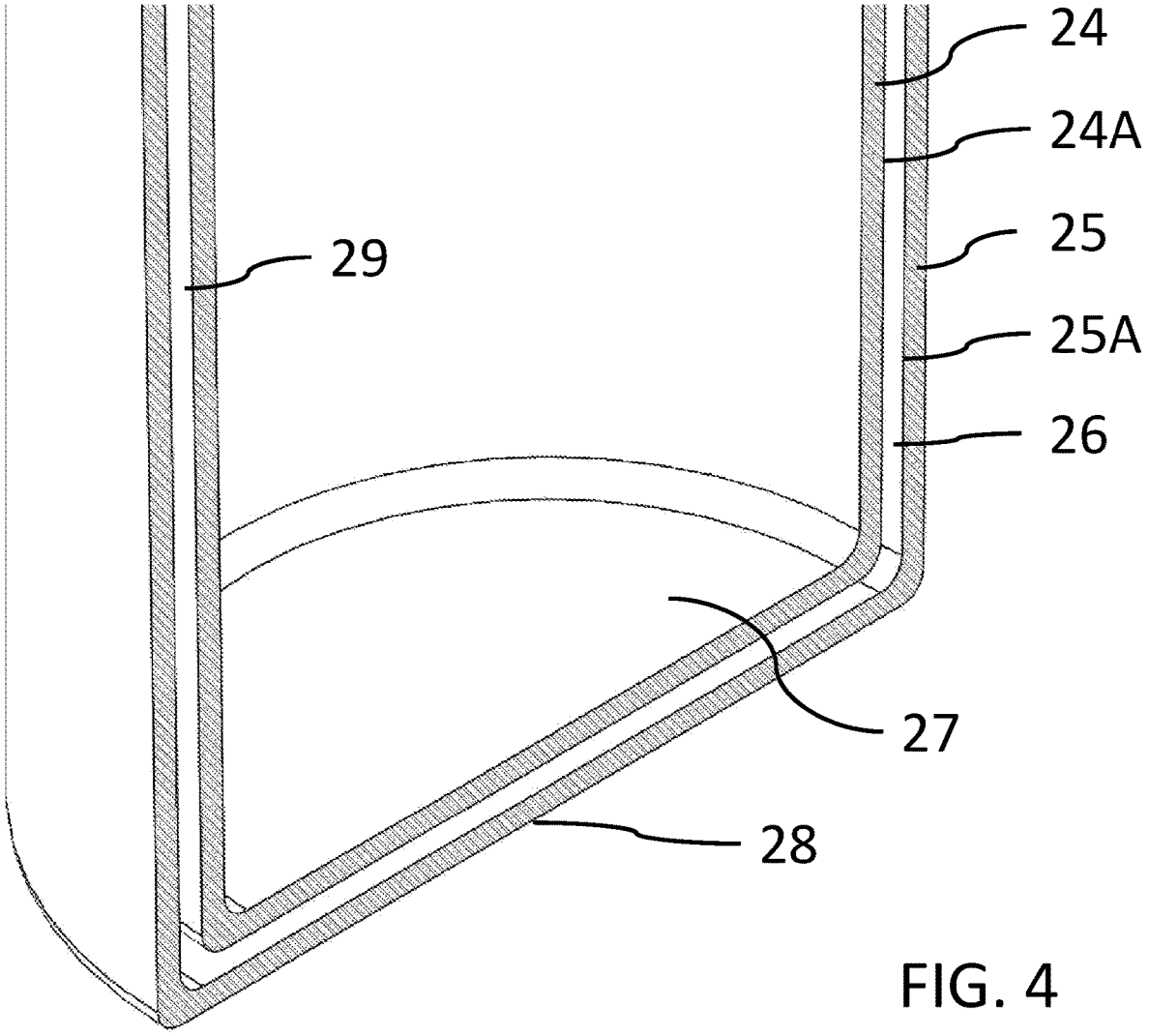
FIG. 4 is a magnified, perspective, cross-section view of the body of the travel mug embodiment shown in FIG. 1.
Figure 5:
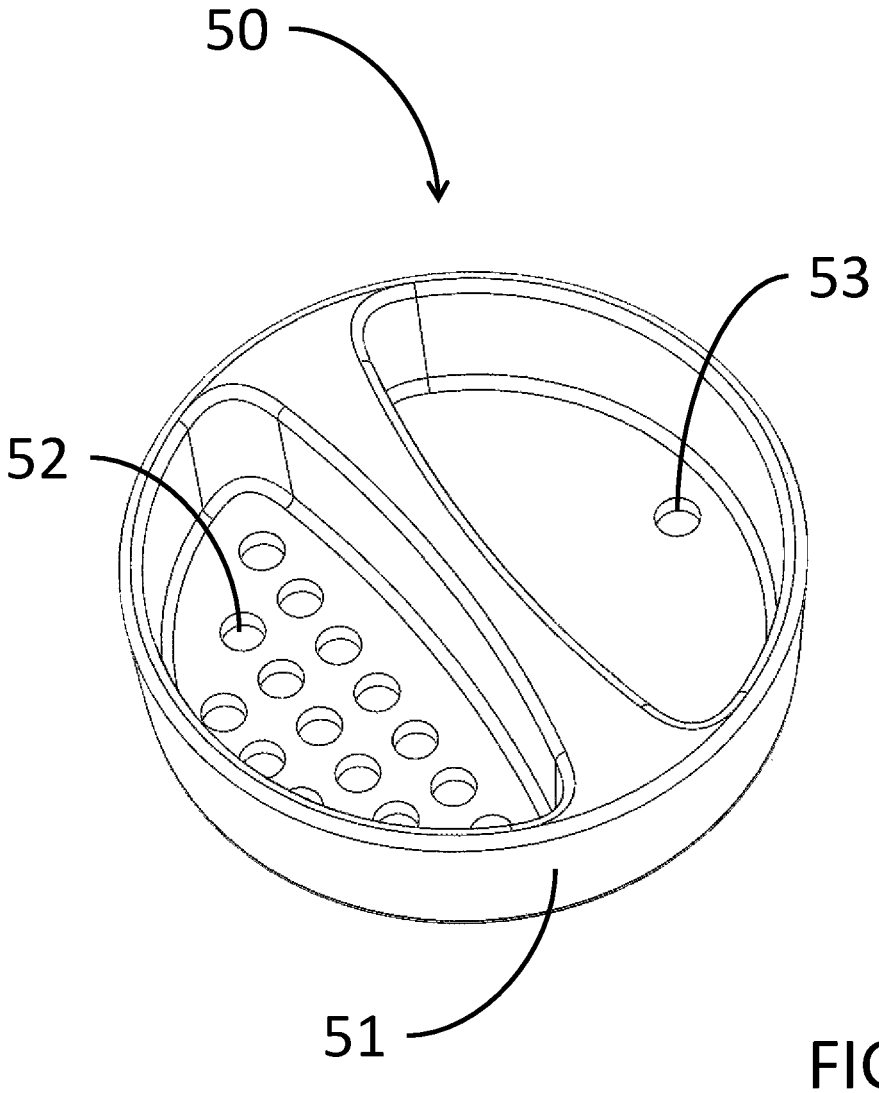
FIG. 5 is a top perspective view of lid according to another embodiment of the disclosure.

As shown in FIGS. 1 and 2, when lid 30 is installed in body 20, an optional clip 40 can be installed to secure lid 30 to the body 20. A clip extension 41 extends axially from clip 40 where clip 40 attaches at an upper-portion 22 of the side of body 20 and reaches around a lip 23 of body 20 and applies a downward force on an exterior 38 of lid 30. Clip extension 41 has a curl 42 at the point where it presses on lid exterior 38 to distribute the load more evenly and to finish the end of clip extension 41. An upward reaction force imparted by lid 30 on clip 40 is opposed by the connection of clip 40 to body 20, which is established by two secondary clip extensions, 43*a* and 43*b*, that wrap around the circumference of an upper portion 22 of body 20. In an alternative embodiment, upper portion 22 of body 20 has a rising and expanding taper, which prevents clip 40 from sliding up body 20 and reducing the retaining force exerted on lid 30.

The disclosure also conceives other methods of attaching clip 40 and other possible shapes for body 20 including a straight cylinder. Body 20 can take on the shape of any regular or irregular geometric shape in cross-section and remain within the scope of the disclosure. The ends of secondary extensions 43*a* and 43*b* have curls, 44*a* and 44*b*, respectively, to facilitate installing and removing clip 40 and to finish the ends of the extensions 43*a* and 43*b*. Clip 40 may be formed from an elastic metal with high-yield strength to facilitate installation and removal without permanent deformation.

Figure 6:
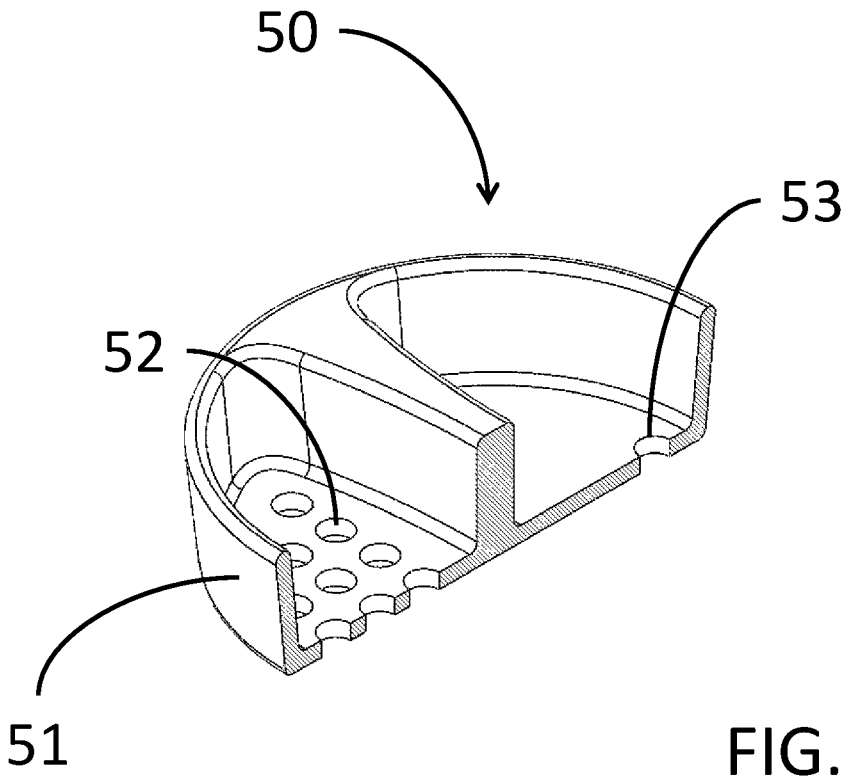
FIG. 6 is a top perspective, cross-section view of the lid shown in FIG. 5.

In another aspect of the disclosure, a modified an alternative lid 50 is sealed to body 20 with a ground glass joint. The joint consists of a ground-glass face 51 on lid 50 and a ground-glass face 21 on the body 20. The mating faces, 21 and 51, are frustoconical in shape and are formed with the same angle so that registration between the faces is maximized over the full extent of the mating surface area. Alternative lid 50 is formed with a plurality of holes or through-bores 52 on a first half of alternative lid 50 and at least one hole or through-bore 53 formed on and defined by a second half of alternative lid 50, wherein the plurality of holes 52 on the first half of alternative lid 50 act as a strainer for loose leaf tea or similar beverage and the at least one hole 53 on the second half of alternative lid 50 functions as a vent hole. One or both the first half and the second half of alternative lid 50 may be recessed as shown in FIG. 6 to receive fluids, solids and/or mixtures thereof. Alternative lid 50 also sits below the lip of the body 23 to facilitate drinking from beverage container 10 with the lips pressed against body 20 so beverage fluid can be directed toward the mouth by face 21 and lip 23 while drinking.

As described herein, the disclosed beverage containers may be constructed from glass materials. A particularly advantageous material is low-thermal-expansion borosilicate glass. The low thermal expansion property of this glass material helps to prevent the glass joint from binding and makes the vessel more stable against thermal shock. Borosilicate glass is also harder than the more common soda lime glass, a property that makes the joint surfaces more stable against wear. It should be understood that any glass material including glass made from silicates can be used to construct the disclosed beverage containers and remain within the scope of the disclosure.

To operate any of the embodiments of the disclosed beverage container 10, the user fills the interior chamber of body 20 with the desired beverage and places lid 30 on body 20, snuggly fitting the faces of the glass joint. And then, if additional security in the joint is desired, clip 40 may optionally be applied to the assembly with first curl 42 applied to lid 30 opposite the drinking port, and then secondary extensions 43*a* and 43*b* positioned around upper portion 22 of body 20. When the user is finished consuming their beverage, the assembly is disassembled in reverse order. If optionally installed, first clip 40 is removed by exerting a force against curls 44*a* and 44*b* at the ends of extensions 43*a* and 43*b*, to push them off lid 30 while simultaneously applying a removal pressure by using grip 34. For cleaning all the components, body 20, lid 30, and clip 40 can be machine washed in a dishwasher using a standard cycle with heated drying.

While the present disclosure has been described in connection with several embodiments thereof, it will be apparent to those skilled in the art that many changes and modifications may be made without departing from the true spirit and scope of the present disclosure. Accordingly, it is intended by the appended claims to cover all such changes and modifications as come within the true spirit and scope of the disclosure.

What I claim as new and desire to secure by United States Letters Patent is:

1. A beverage container comprising:

a body having a closed bottom end, an open upper end, and constructed from glass, wherein the body is formed with at least one wall, and wherein an inner face of the at least one wall proximal the upper end is formed from ground glass to form a first half of a discontinuous or interrupted glass joint; and, a lid constructed from glass having a top lid surface and a bottom lid surface spaced by a lid side face, wherein the lid has portions defining a drinking port or side channel that extends from the top lid surface down to the bottom lid surface and partially defined by portions of the lid side face that creates a discontinuity or interruption in the lid side face and other portions that define a vent port or vent channel that extends from the top lid surface down to the bottom lid surface partially defined by portions of the lid side face that creates a discontinuity or interruption in the lid side face, wherein the lid side face is formed from ground glass to form a second half of the discontinuous or interrupted glass joint, wherein the lid side face mates with, and registers against, the inner face of the at least one wall, except at the locations of the drinking port and the vent port, to form the discontinuous or interrupted glass joint when the lid is inserted into the upper open end of the body.

2. The beverage container of claim 1 wherein the at least one wall is a double wall having an inner wall and an outer wall, wherein a wall gap is defined by an inner surface of the outer wall and an outer surface of the inner wall, wherein the closed bottom end is formed with an inner bottom wall and an outer bottom wall to form a double bottom wall with the inner bottom wall continuous with the inner wall and the outer bottom wall continuous with the outer wall, wherein a bottom gap defined by an inner surface of the outer bottom wall and an outer surface of the inner bottom wall is continuous with the wall gap.

3. The beverage container of claim 2 wherein the lid has a cavity defined by the upper lid surface, the lower lid surface and the lid side wall.

4. The beverage container of claim 3 wherein the inner surface of the at least one wall proximal the upper open end is frustoconical in shape, and wherein the lid side wall is frustoconical in shape to mate with the inner surface of the at least one wall proximal the upper open end.

5. The beverage container of claim 2 wherein at least one surface of the inner surface of the outer wall and the outer surface of the inner wall is at least partially coated with an infrared-reflecting coating.

6. The beverage container of claim 5 wherein the infrared reflective coating is coated onto the at least one surface in an artistic pattern.

7. The beverage container of claim 2 wherein the wall gap is filled with an insulating gas, wherein the insulating gas is selected from the group consisting of air, low-oxygen gas, low-pressure gas, low-conductivity gas and mixtures thereof.

8. The beverage container of claim 1 wherein the lid has a cavity defined by the upper lid surface, the lower lid surface and the lid side wall.

9. The beverage container of claim 8 wherein at least one surface of the walls defining the cavity is coated with infrared-reflecting coating.

10. The beverage container of claim 8 wherein the cavity is filled with an insulating gas, wherein the insulating gas is selected from the group consisting of air, low-oxygen gas, low-pressure gas, low-conductivity gas and mixtures thereof.

11. The beverage container of claim 1 wherein the inner face of the at least one wall proximal the upper open end is frustoconical in shape, and wherein the lid side face is frustoconical in shape to mate with the inner face of the at least one wall proximal the upper open end.

12. The beverage container of claim 1 further comprising a clip formed from a flexible material, wherein the clip registers against the lid and an outer surface of the body to secure the lid to the body.

13. The beverage container of claim 1, wherein the lid is formed with a raised grip, and wherein the upper open end of the body defines a body upper surface, wherein the lid, when inserted into the open upper end of the body, registers against the inner surface of the inner wall whereby the top surface of the lid is level with or below the plane occupied by the body upper surface.

14. The beverage container of 1 wherein the lid is formed with a raised grip.

15. The beverage container of claim 14 wherein the upper open end of the body defines a body upper surface, wherein the lid, when inserted into the open upper end of the body, registers against the inner surface of the inner wall whereby the top surface of the lid is below the plane occupied by the body upper surface.

16. A beverage container comprising:

a body having a closed bottom end, an open upper end, and constructed from glass, wherein the body is formed with at least one wall, and wherein an inner face of the at least one wall proximal the upper end is formed from ground glass to form a first half of a glass joint; and, a lid having a top lid surface and a bottom lid surface spaced by a lid side face, wherein the lid is formed with a raised grip having a depression formed in a central portion of the grip and two raised areas formed on outer portions of the grip, wherein the lid side face is formed from ground glass to form a second half of the glass joint, wherein the lid side face mates with, and registers against, the inner face of the inner wall to form the glass joint when the lid is inserted into the upper open end of the body, and wherein the upper open end of the body defines a body upper surface, wherein the lid, when inserted into the open upper end of the body to form the glass joint, the top surface of the lid and/or the raised grip is level with or below the plane occupied by the body upper surface.

17. The beverage container of claim 16 wherein the inner surface of the inner wall proximal the upper open end is frustoconical in shape, and wherein the lid side wall is frustoconical in shape to mate with the inner wall proximal the upper open end.

18. The beverage container of claim 16 further comprising a clip formed from a flexible material, wherein the clip has an axially extended clip extension that registers against the top surface of the lid to maintain the lid in registration with the body when the clip is registered about an outer surface of the body.

19. The beverage container of claim 16 wherein the at least one wall is a double wall having an inner wall and an outer wall, wherein a wall gap is defined by an inner surface of the outer wall and an outer surface of the inner wall, wherein the closed bottom end is formed with an inner bottom wall and an outer bottom wall to form a double bottom wall with the inner bottom wall continuous with the inner wall and the outer bottom wall continuous with the outer wall, wherein a bottom gap defined by an inner surface of the outer bottom wall and an outer surface of the inner bottom wall is continuous with the wall gap.

20. The beverage container of claim 19 wherein the top lid surface, bottom lid surface and lid side wall define a cavity, wherein the cavity is filled with an insulating gas, wherein the insulating gas is selected from the group consisting of air, low-oxygen gas, low-pressure gas, low-conductivity gas and mixtures thereof.

21. A beverage container comprising:

a body having a closed bottom end, an open upper end, and constructed from glass, wherein the body is formed with at least one wall, and wherein an inner face of the at least one wall proximal the upper end is formed from ground glass to form a first half of a glass joint; and, a lid having a top lid surface and a bottom lid surface spaced by a lid side face, wherein at least one drinking port or channel is formed in the lid that traverses the lid from the top lid surface to the bottom lid surface, wherein a vent port or channel is formed in the lid that traverses the lid from the top lid surface to the bottom lid surface, wherein a surface of the lid side face is formed from ground glass to form a second half of the glass joint, wherein the lid side face registers against the inner face of the at least one wall to form the glass joint when the lid is inserted into the upper open end of the body.

22. The beverage container of claim 21 wherein the at least one wall is formed as a double wall having an inner wall and an outer wall, wherein a wall gap is defined by an inner surface of the outer wall and an outer surface of the inner wall, wherein the closed bottom end is formed with an inner bottom wall and an outer bottom wall to form a double bottom wall with the inner bottom wall continuous with the inner wall and the outer bottom wall continuous with the outer wall, and wherein a bottom gap defined by an inner surface of the outer bottom wall and an outer surface of the inner bottom wall is continuous with the wall gap.

23. The beverage container of claim 22 wherein the inner surface of the inner wall proximal the upper open end is frustoconical in shape, and wherein the lid side wall is frustoconical in shape to mate with the inner wall proximal the upper open end.

24. The beverage container of claim 21 wherein the inner surface of the inner wall proximal the upper open end is frustoconical in shape, and wherein the lid side wall is frustoconical in shape to mate with the inner wall proximal the upper open end.

25. The beverage container of claim 21 further comprising a clip formed from a flexible material, wherein the clip has an axially extended clip extension that registers against the top surface of the lid to maintain the lid in registration with the body when the clip is registered about an outer surface of the body.

26. The beverage container of claim 21 wherein the upper open end of the body defines a body upper surface, wherein the lid is formed with a raised grip, and wherein the lid, when inserted into the open upper end of the body, registers against the inner surface of the inner wall whereby the top surface of the lid is level with or below the plane occupied by the body upper surface.

27. The beverage container of claim 21 wherein the top lid surface defines a first half recess and a second half recess, wherein the first half recess is formed with at least one through-bore, wherein the second half recess is formed with at least one through-bore.

28. The beverage container of claim 21 wherein the lid is formed with a raised grip, wherein the raised grip is ergonomically shaped with a depression formed toward a central portion of the raised grip and two raised areas formed near outer portions of the raised grip to allow for drinking with the glass joint engaged and for manipulation of the lid by hand to insert and extract the lid.

* * * * *